US007530759B2

(12) United States Patent
Gelfand et al.

(10) Patent No.: US 7,530,759 B2
(45) Date of Patent: May 12, 2009

(54) RETRACTABLE ENERGY ABSORBING SYSTEM

(75) Inventors: Matthew A. Gelfand, Rockville Centre, NY (US); Joel F. Hugghins, Bryan, TX (US)

(73) Assignee: Universal Safety Response, Inc., Franklin, TN (US)

( * ) Notice: Subject to any disclaimer, the term of this patent is extended or adjusted under 35 U.S.C. 154(b) by 0 days.

(21) Appl. No.: 10/991,030

(22) Filed: Nov. 17, 2004

(65) Prior Publication Data

US 2006/0104713 A1 May 18, 2006

(51) Int. Cl.
*E01F 15/00* (2006.01)
*E01F 15/12* (2006.01)

(52) U.S. Cl. ..... 404/10; 404/6; 404/9

(58) Field of Classification Search ..... 404/6, 404/9, 10

See application file for complete search history.

(56) References Cited

U.S. PATENT DOCUMENTS 2,440,574 A 4/1948 Cotton
2,675,197 A 4/1954 Hospers
3,838,391 A 9/1974 Mintz
3,880,404 A 4/1975 Fitch
4,627,763 A 12/1986 Roemer et al.
4,775,261 A 10/1988 Fladung
4,823,923 A * 4/1989 Moyer ..... 188/376
4,824,282 A * 4/1989 Waldecker ..... 404/6
4,828,424 A 5/1989 Crisp
5,228,237 A 7/1993 Nasatka
6,062,765 A * 5/2000 Dotson ..... 404/6
6,308,809 B1 * 10/2001 Reid et al. ..... 188/377
6,536,985 B2 * 3/2003 Albritton ..... 404/6
6,554,529 B2 4/2003 Stephens et al.
7,040,836 B2 5/2006 Rogers et al.

OTHER PUBLICATIONS

International Search Report, PCT/US05/38875, Oct. 23, 2006, 2 pages.
Written Opinion of the International Searching Authority, PCT/US05/38875, Oct. 23, 2006, 6 pages.

* cited by examiner

*Primary Examiner*—Raymond W Addie

(57) ABSTRACT

An energy absorbing system. The energy absorbing system includes a supporting member, a barrier mechanically coupled to the supporting member, the barrier pivotable between a substantially horizontal position and a predetermined angle, and an energy absorber mechanically coupled to the supporting member, wherein the energy absorber absorbs energy when the supporting member travels from a first position to a second position.

10 Claims, 22 Drawing Sheets

RETRACTABLE ENERGY ABSORBING SYSTEM

BACKGROUND

This invention relates to a retractable energy absorbing system where the system can be used to dissipate energy such as, e.g., the energy of a vehicle. The system may be used in a variety of applications, including HOV lane traffic control, drawbridges, security gates, or crash cushion applications. In one application, the system may be mobile, so that it may be moved between locations.

SUMMARY OF THE DISCLOSURE

The present disclosure relates to an energy absorbing system. In one aspect, the energy absorbing system includes a supporting member, a barrier mechanically coupled to the supporting member, the barrier pivotable between a substantially horizontal position and a predetermined angle, and an energy absorber mechanically coupled to the supporting member, wherein the energy absorber absorbs energy when the supporting member travels from a first position to a second position.

In another aspect, the energy absorber is arranged such that the energy absorber expands when the supporting member travels from the first position to the second position. In another aspect, the energy absorber is arranged such that the energy absorber compresses when the supporting member travels from the first position to the second position.

In another aspect, a guide mechanically coupled to the supporting member is arranged such that the guide causes the supporting member to move in a direction of the guide when the supporting member moves from the first position to the second position.

DETAILED DESCRIPTION OF THE PREFERRED EMBODIMENTS

Figure 1:
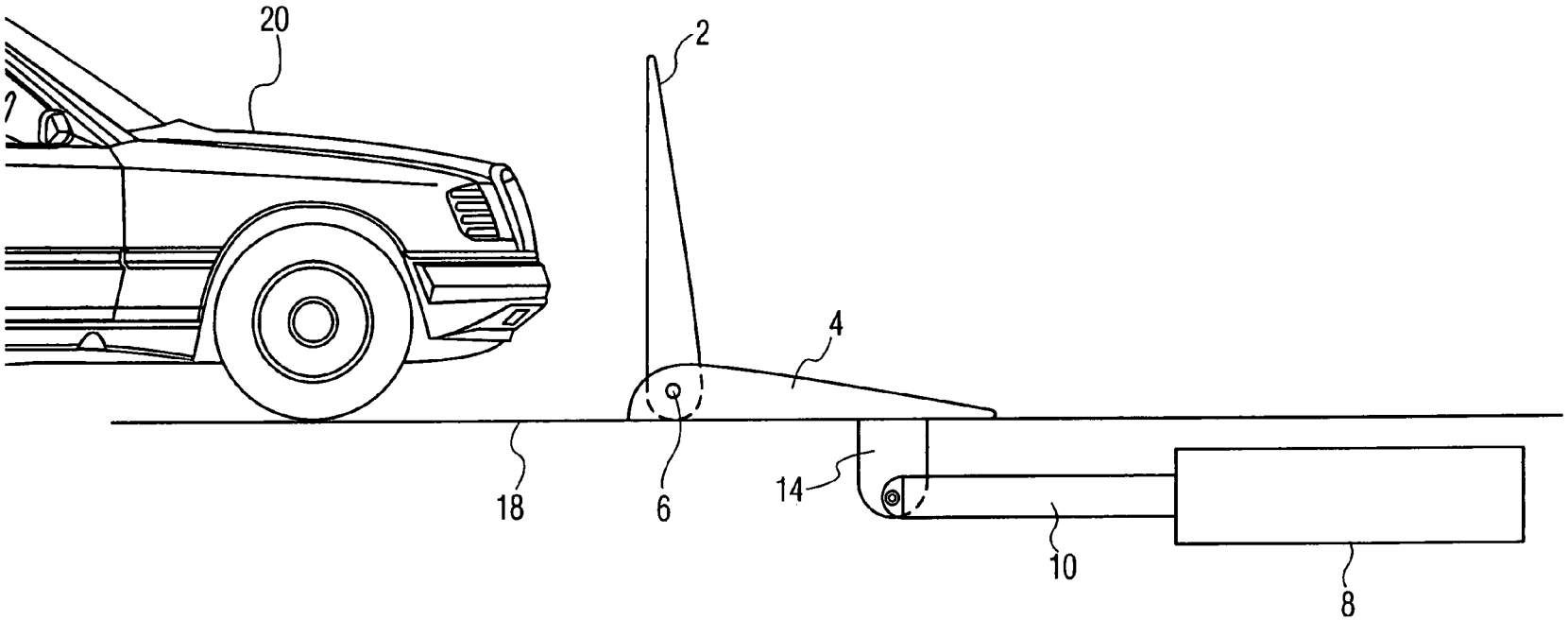
FIG. 1 shows a side view of a retractable energy system according to an aspect of the present disclosure.

Referring to the drawings, wherein like reference numerals represent identical or corresponding parts throughout the several views, and more particularly to FIG. 1, a side view of a general layout of an embodiment according to one aspect of the system of the present disclosure is shown. The system may include impact barrier 2, sled 4, hinge 6, and one or more energy absorbers 8, which may be any device or system that dissipates, redirects or absorbs energy. Impact barrier 2 and sled 4 may be fabricated from metal, rebar reinforced rubber, ceramic, plastic or composite material. Hinge 6 may be a solid pin, gear and shaft, or sprocket gear. Energy absorber 8 may be shock absorber having piston 10. In other aspects, energy absorber 8 may include a dynamic breaking system, one or more shear pins, springs, foams, pneumatics, hydraulics, woven cable or cloth, friction bearings, breakable concrete or crushable metals or systems utilizing gravity or counterbalance weights.

To provide flexibility, piston 10 may connect to sled 4 via flange 14. Impact barrier 2 may be arranged so that it may be in at least a raised position, as shown in FIG. 1, or a lowered position. Raised position of impact barrier 2 may be substantially perpendicular to the ground or may be at another angle to the ground, such as a 45 degree angle. In one aspect, a vehicle 20 traveling on a roadway at ground level 18 may make contact with impact barrier 2, thereby causing impact barrier 2 and sled 4 to travel horizontally, thereby causing energy absorber 8 to absorb energy and the vehicle 20 to decelerate.

Figure 2A:
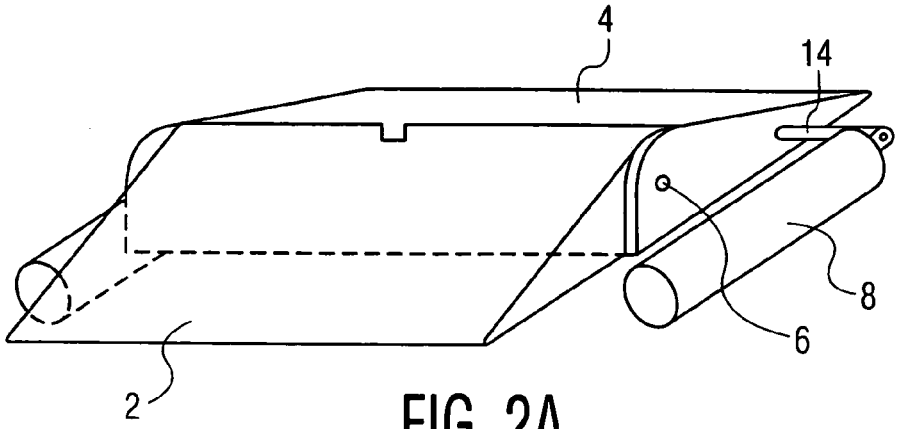
FIGS. 2*a*-2*c* show a perspective view of a retractable energy absorbing system according to another aspect of the present disclosure.
Figure 2B:
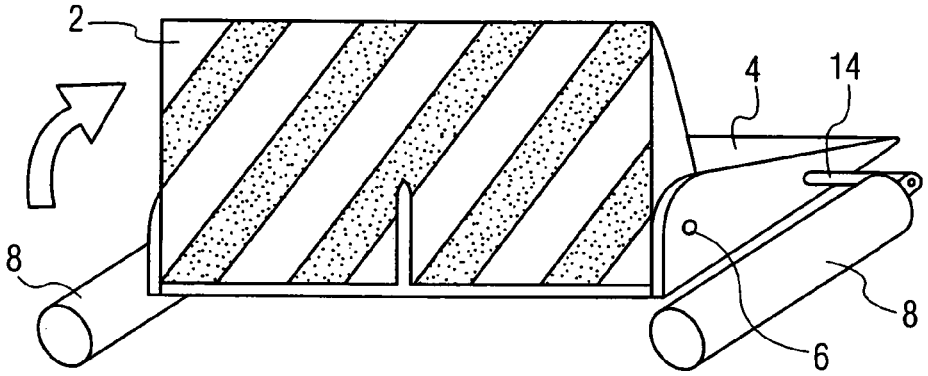
Figure 2C:
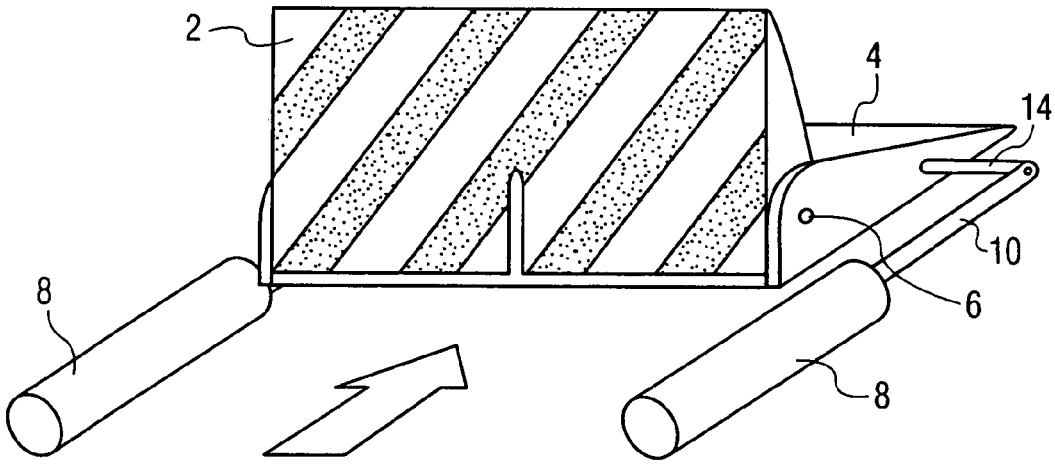

FIGS. 2*a*-2*c* show a perspective view of a retractable energy absorbing system according to another aspect of the present disclosure. FIGS. 2*a* and 2*b* show a perspective view of a retractable energy absorbing system with impact barrier 2 in a lowered position and raised position, respectively. FIGS. 2*a* and 2*b* show the system prior to impact, with impact barrier 2 and sled 4 in an original position and pistons 10 in a compressed state. Energy absorbers 8 may be immovably fixed at, above or below ground level 18. FIG. 2*c* shows the system with the impact barrier 2 and sled 4 displaced from the original position in a direction of impact and shows pistons 10 in an extended state. Note that, as compared to the arrangement of FIG. 1, the energy absorbers 8 in FIGS. 2*a*-2*c* have been repositioned.

Figure 13A:
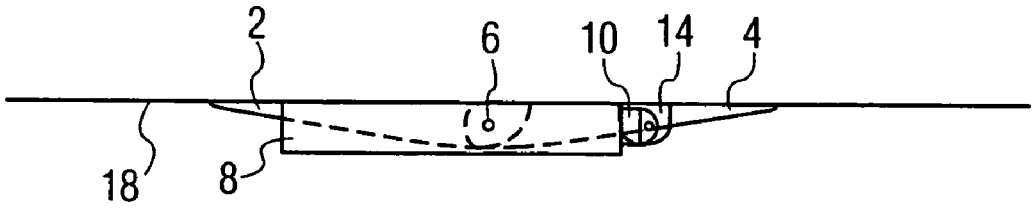
FIGS. 13*a* and 13*b* show a side view of a retractable energy absorbing system according to additional aspects of the present disclosure.
Figure 13B:
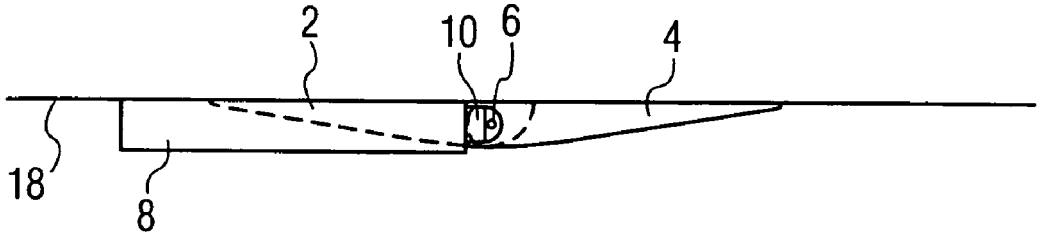
Figure 14A:
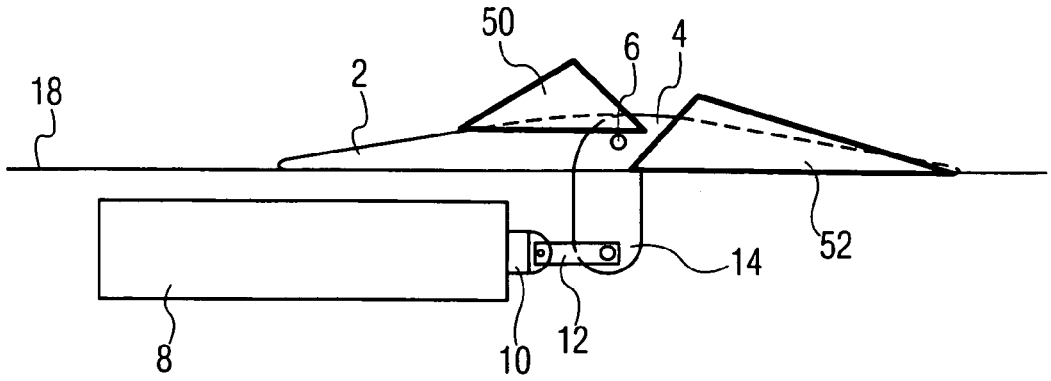
FIGS. 14*a* and 14*b* show a side view of a retractable energy absorbing system according to another aspect of the present disclosure.
Figure 14B:
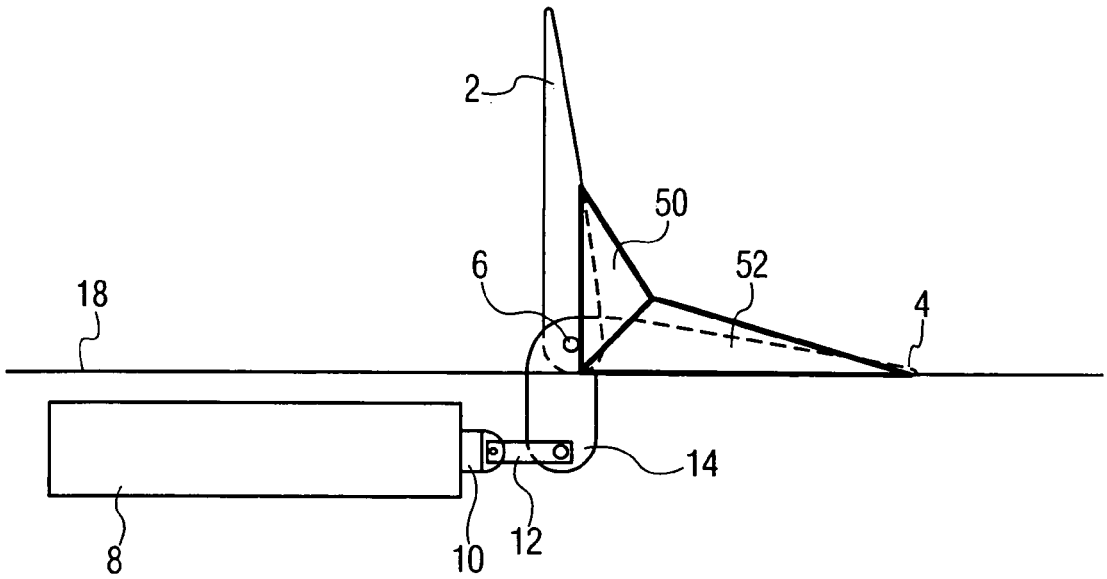
Figure 15:
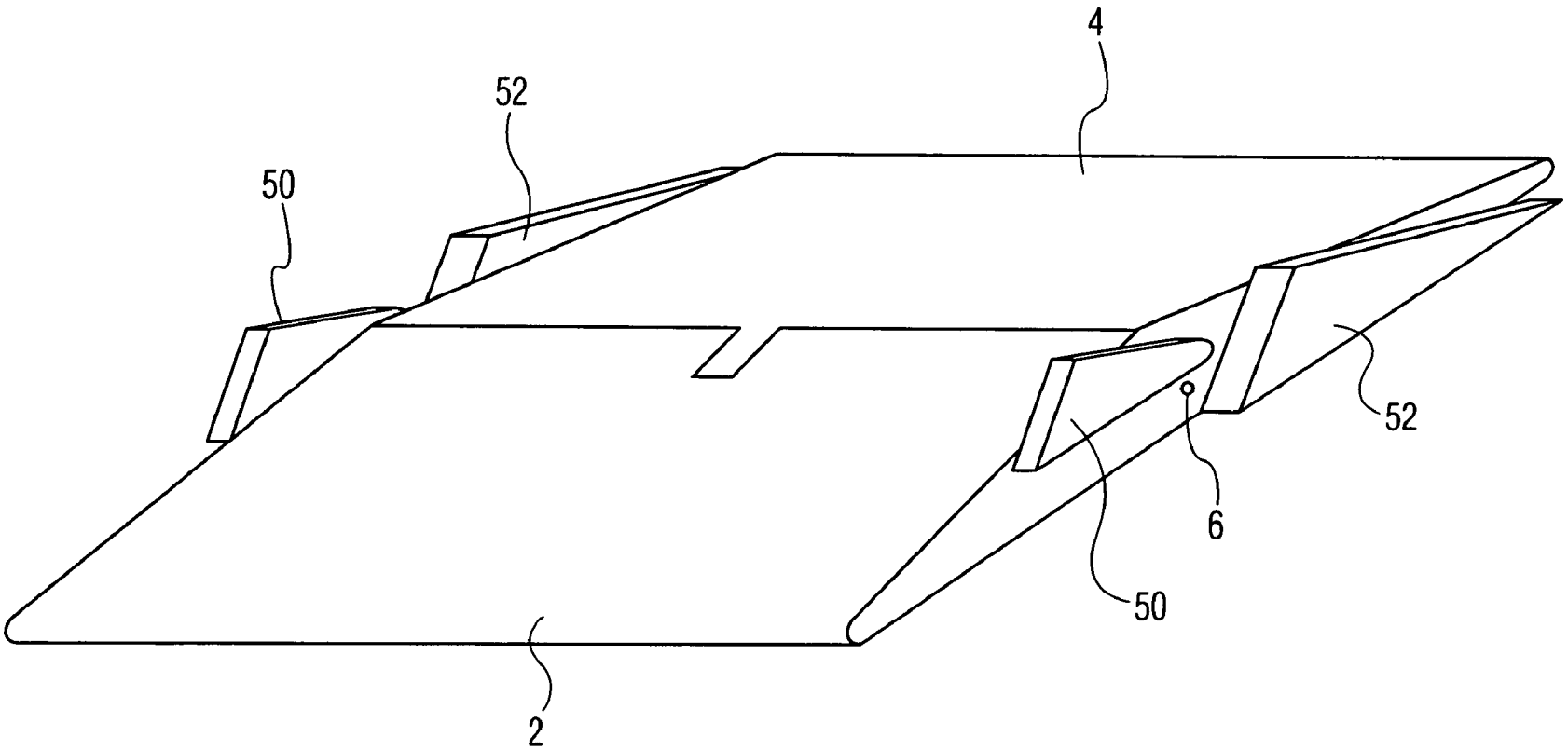
FIG. 15 shows a perspective view of a retractable energy absorbing system according to another aspect of the present disclosure.

Impact barrier 2 and/or sled 4 may have a sloped or teardrop shape on at least one side as shown in FIG. 2*a*, so that they may act similarly to a speed bump while permitting a vehicle to pass over when in the lowered position. In an aspect shown in FIGS. 13*a* and 13*b*, the shapes of impact barrier 2 and sled 4 may be inverted so that a vehicle encounters a non-sloped or flat shape.

Figure 3A:
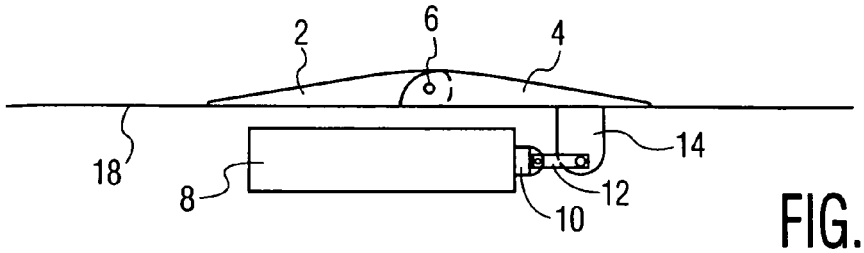
FIGS. 3*a*-3*d* show a side view of a retractable energy absorbing system according to additional aspects of the present disclosure.
Figure 3B:
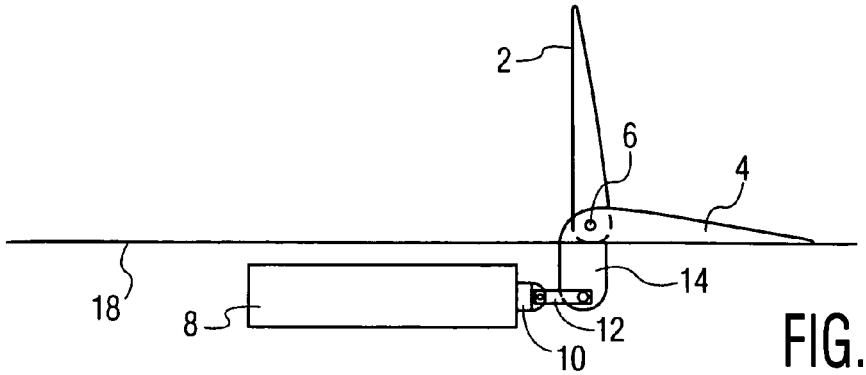

FIGS. 3*a*-3*d* show a side view of a retractable energy absorbing system according to additional aspects of the present disclosure. FIGS. 3*a*-3*d* show energy absorber 8 arranged in a manner such that an application of force to impact barrier 2 may cause piston 10 to expand. In FIG. 3*a*, impact barrier 2 is shown in a lowered position, and in FIG. 3*b*, impact barrier 2 is shown in a raised position. FIGS. 3*a* and 3*b* show impact barrier 2 and sled 4 above ground level 18, with energy absorber 8 located below ground level 18. As shown in FIGS. 3*a* and 3*b*, connector 12 and flange 14 may attach energy absorber 8 to sled 4, for example, at or near distal and proximal ends, respectively. In this and other aspects, piston 10 of energy absorber 8 may be connected to flange 14 via connector 12. Connector 12 may include a 'U' shaped joint and flange 14 may fit inside connector 12 and be secured by a pin (not shown). In other aspects, flange 14 may be located underneath or to the side of sled 4 depending on the location of energy absorber 8.

Figure 3C:
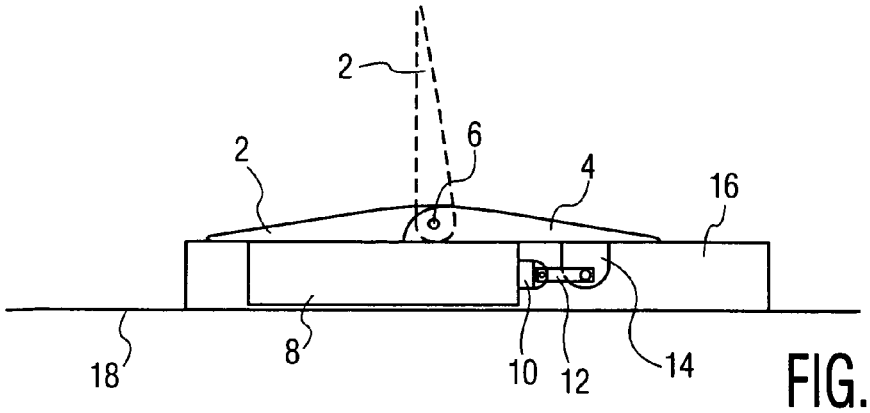
Figure 3D:
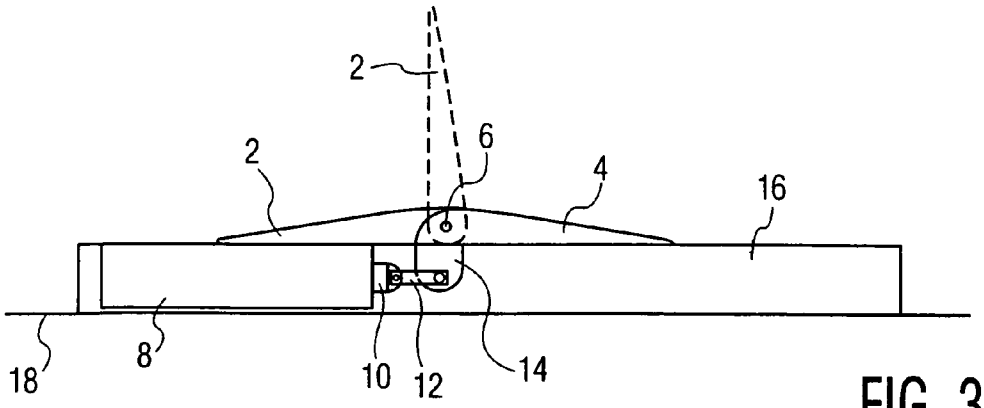

As shown in FIGS. 3*c* and 3*d*, impact barrier 2 and sled 4 may be arranged above ground level 18 using housing 16, with energy absorber 8 located within housing 16. As yet another alternative, energy absorber 8 may be partially above and beneath ground level 18. For illustrative purposes, FIGS. 3*c* and 3*d* show impact barrier 2 in a lowered position as well as in a raised position (in dashed lines).

In various aspects of the system of the present disclosure, one or more energy absorbers 8 may be attached at or between proximal and distal ends of sled 4, above, at or below ground level 18 and may be attached to sled 4 using flange 14, connector 12, hinge 6, other connection device or any combination thereof. Housing 16 may be used to facilitate portability and may provide a secure, sealed enclosure for the preservation of the internal workings of the system from contaminants and moisture.

Figure 4A:
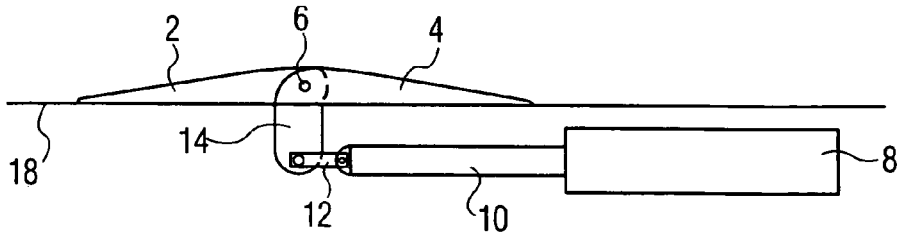
FIGS. 4*a*-4*d* show a side view of a retractable energy absorbing system according to additional aspects of the present disclosure.
Figure 4B:
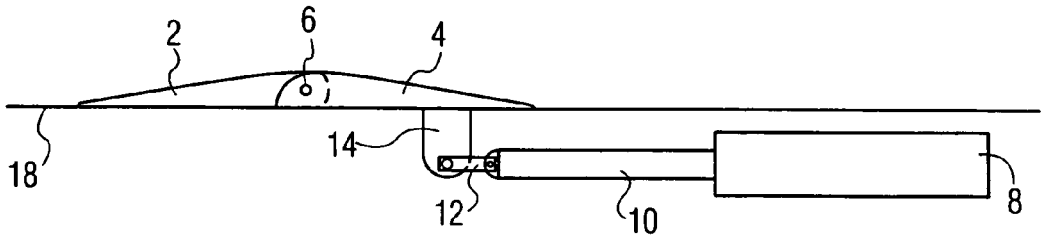

FIGS. 4*a*-4*d* show a side view of a retractable energy absorbing system according to additional aspects of the present disclosure. FIGS. 4*a*-4*d* show energy absorber 8 arranged in a manner such that an application of force to impact barrier 2 may cause piston 10 to compress. FIGS. 4*a* and 4*b* show impact barrier 2 and sled 4 above ground level 18, with energy absorber 8 located below ground level 18. As shown in FIGS. 4*a* and 4*b*, connector 12 and flange 14 may attach energy absorber 8 to sled 4, for example, at or between proximal and distal ends, respectively.

Figure 4C:
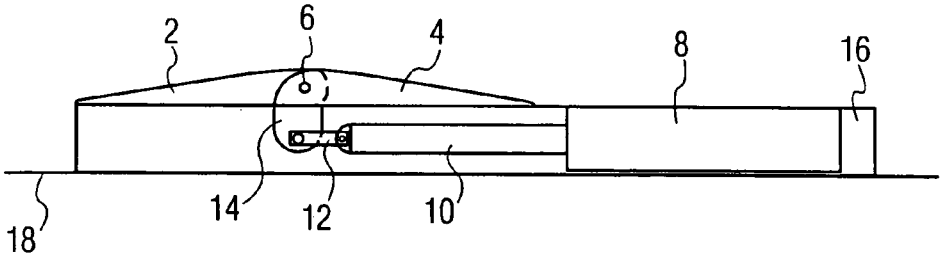
Figure 4D:
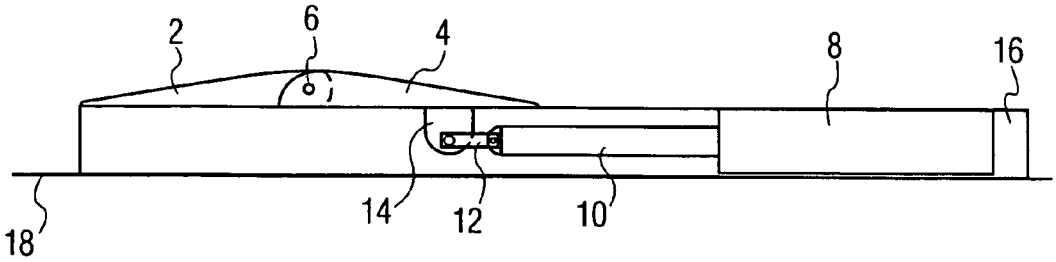

As shown in FIGS. 4*c* and 4*d*, impact barrier 2 and sled 4 may be arranged above ground level 18 using housing 16, with energy absorber 8 located within housing 16. As with the arrangement of FIGS. 3*a*-3*d*, energy absorber 8 of FIGS. 4*a*-4*d* may be partially above and beneath ground level 18.

Figure 5A:
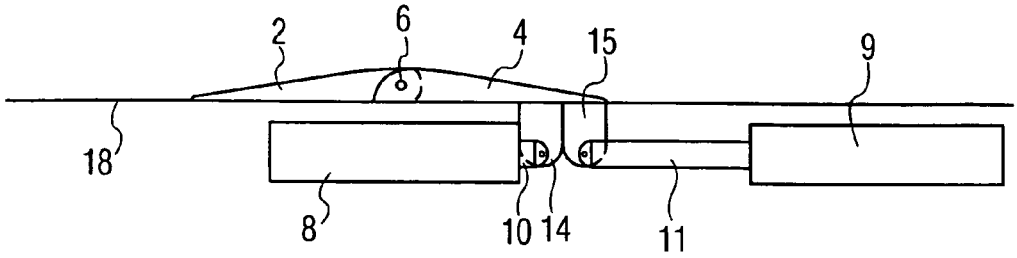
FIGS. 5*a*-5*d* show a side view of a retractable energy absorbing system according to additional aspects of the present disclosure.
Figure 5B:
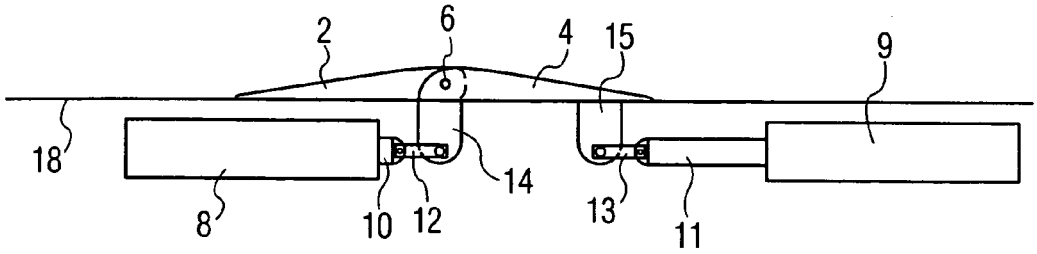
Figure 5C:
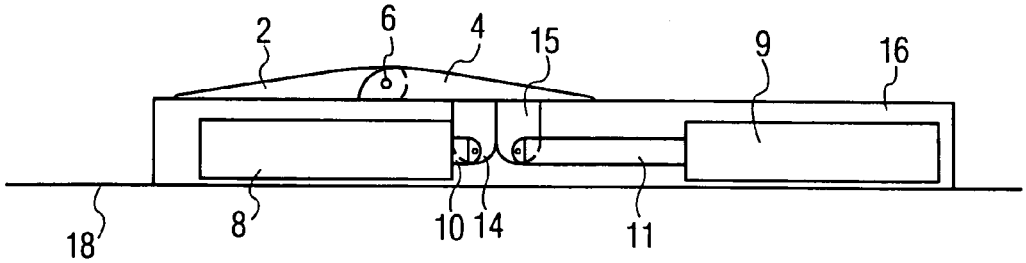
Figure 5D:
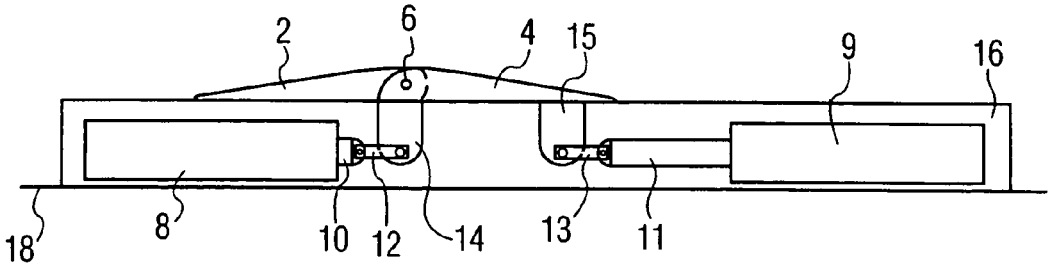

FIGS. 5*a*-5*d* show a side view of a retractable energy absorbing system according to further aspects of the present disclosure. FIGS. 5*a*-5*d* show energy absorbers 8 and 9 arranged in a manner such that an application of force to impact barrier 2 may cause piston 10 to extend and piston 11 to compress. FIGS. 5*a* and 5*b* show impact barrier 2 and sled 4 above ground level 18, with energy absorbers 8 and 9 located below ground level 18. As shown in FIGS. 5*a* and 5*c*, pistons 10 and 11 may attach to flanges 14 and 15 respectively at a distal end of sled 4. As shown in FIGS. 5*b* and 5*d*, piston 10 may attach to flange 14 at a proximal end of sled 4 via connector 12 and piston 11 may attach to flange 15 at a distal end of sled 4 via connector 13.

As shown in FIGS. 5*c* and 5*d*, impact barrier 2 and sled 4 may be arranged above ground level 18 using housing 16, with energy absorbers 8 and 9 located within housing 16. Once again, energy absorber 8, shown in FIGS. 5*a*-5*d* may be partially above and below ground level 18.

Figure 6A:
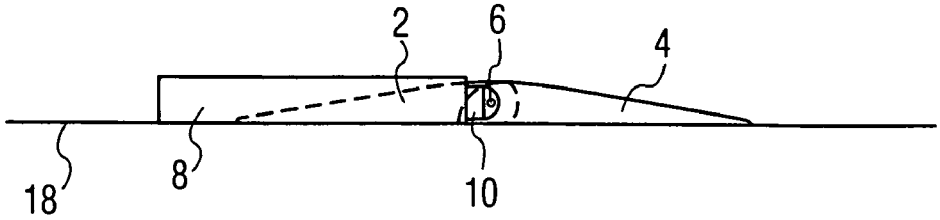
FIGS. 6*a*-6*d* show a side view of a retractable energy absorbing system according to additional aspects of the present disclosure.
Figure 6B:
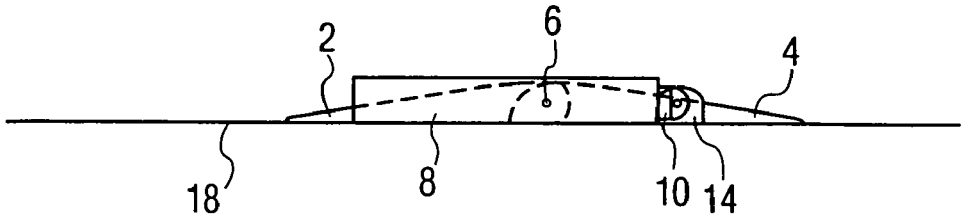
Figure 6C:
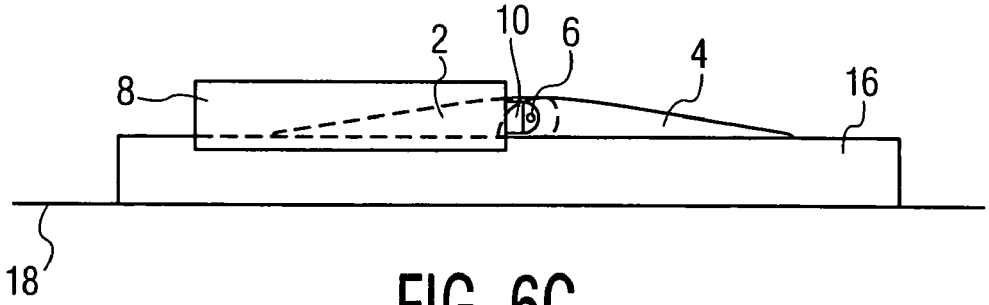
Figure 6D:
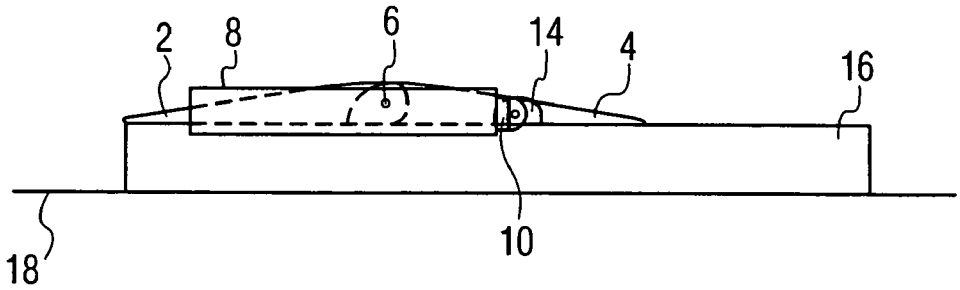

FIGS. 6*a*-6*d* show a side view of a retractable energy absorbing system according to further aspects of the present disclosure. FIGS. 6*a*-6*d* show energy absorber 8 arranged in a manner such that an application of force to impact barrier 2 may cause piston 10 to extend. FIGS. 6*a* and 6*b* show impact barrier 2 and sled 4 above ground level 18, with energy absorber 8 located at the side of sled 4 at or above ground level 18. Energy absorber 8 may attach to sled 4, for example, at or between distal and proximal ends. As shown in FIGS. 6*a* and 6*c*, piston 10 may attach to sled 4 at hinge 6. As shown in FIGS. 6*b* and 6*d*, piston 10 may attach to flange 14 at or near a distal end of sled 4.

As shown in FIGS. 6*c* and 6*d*, impact barrier 2 and sled 4 may be arranged above ground level 18 using housing 16, with energy absorber 8 located on or within housing 16.

Figure 7A:
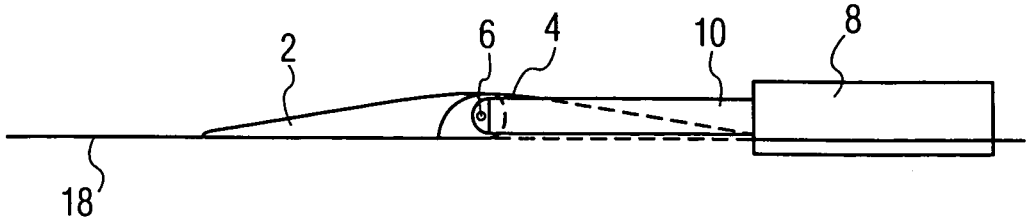
FIGS. 7*a*-7*d* show a side view of a retractable energy absorbing system according to additional aspects of the present disclosure.
Figure 7B:
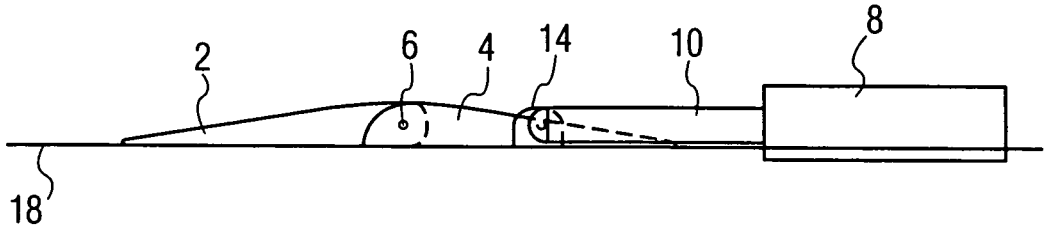
Figure 7C:
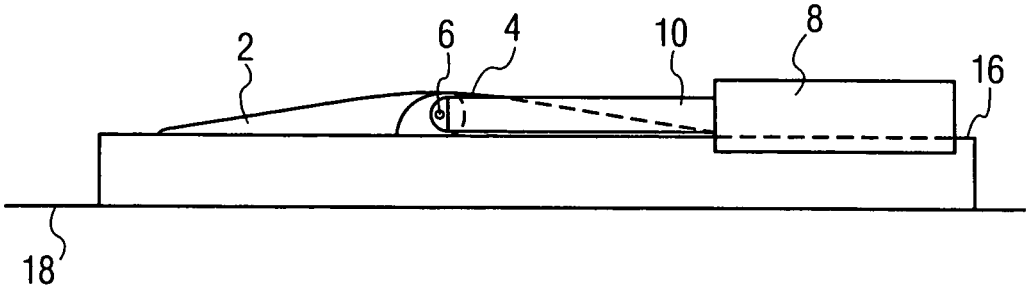
Figure 7D:
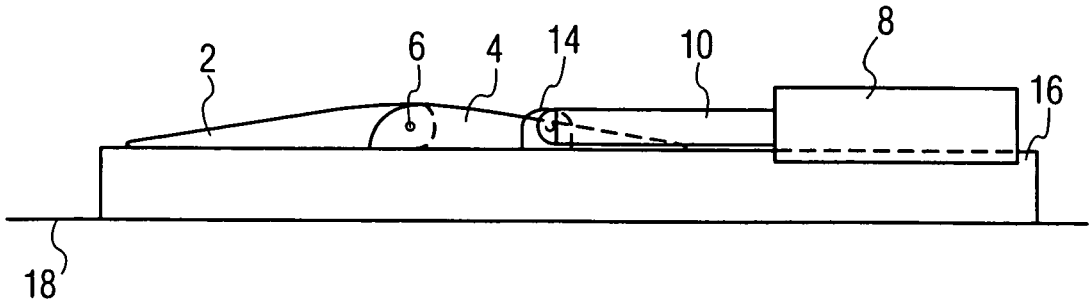

FIGS. 7*a*-7*d* show a side view of a retractable energy absorbing system according to further aspects of the present disclosure. FIGS. 7*a*-7*d* show energy absorber 8 arranged in a manner such that an application of force to impact barrier 2 may cause piston 10 of energy absorber 8 to compress. FIGS. 7*a* and 7*b* show impact barrier 2 and sled 4 above ground level 18, with energy absorber 8 located at the sides of sled 4 at or above ground level 18. Energy absorber 8 may attach to sled 4 at or between proximal and distal ends. As shown in FIGS. 7*a* and 7*c*, piston 10 may attach to sled 4 at hinge 6. As shown in FIGS. 7*b* and 7*d*, piston 10 may attach to flange 14 at or near a distal end of sled 4.

As shown in FIGS. 7*c* and 7*d*, impact barrier 2 and sled 4 may be arranged above ground level 18 using housing 16, with energy absorber 8 located on or within housing 16.

Figure 8A:
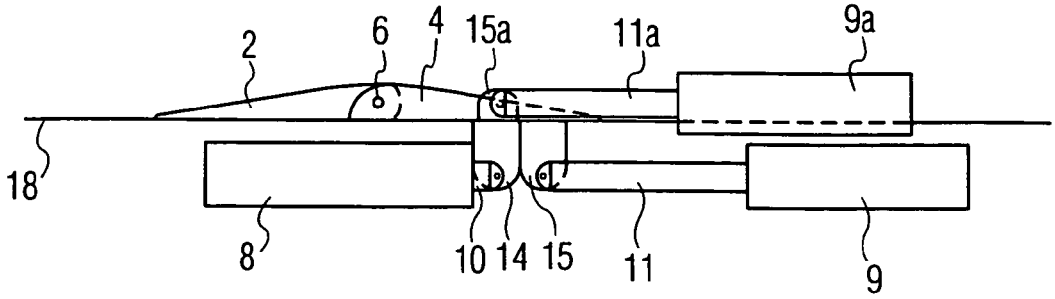
FIGS. 8*a*-8*d* show a side view of a retractable energy absorbing system according to additional aspects of the present disclosure.
Figure 8B:
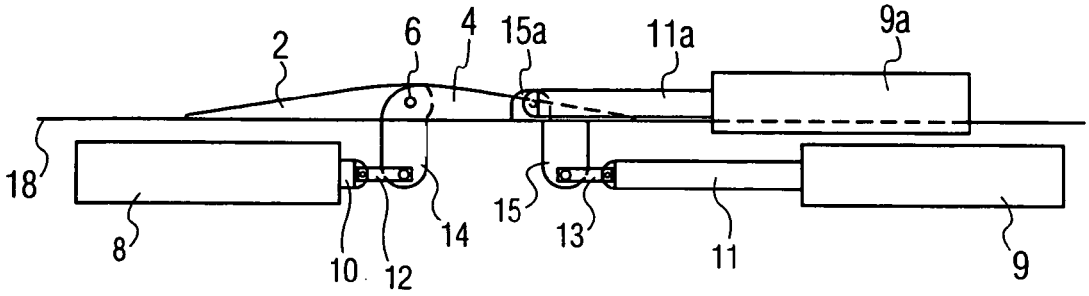

FIGS. 8*a*-8*d* show a side view of a retractable energy absorbing system according to further aspects of the present disclosure. FIGS. 8*a*-8*d* show energy absorbers 8, 9 and 9*a* arranged in a manner such that an application of force to impact barrier 2 may cause piston 10 to extend and pistons 11 and 11*a* to compress. FIGS. 8*a* and 8*b* show impact barrier 2 and sled 4 above ground level 18, energy absorbers 8 and 9 located below ground level 18, and energy absorber 9*a* located at the side of sled 4 at or above ground level 18. As shown in FIG. 8*a*, pistons 10, 11 and 11*a* may attach to flanges 14, 15 and 15*a* respectively at or near a distal end of sled 4. As shown in FIG. 8*b*, piston 10 may attach to flange 14 at or near a proximal end of sled 4 and pistons 11 and 11*a* may attach to flanges 15 and 15*a* at or near a distal end of sled 4.

Figure 8C:
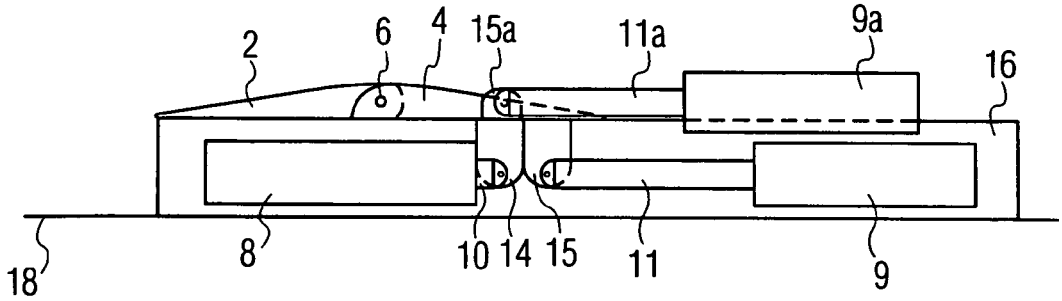
Figure 8D:
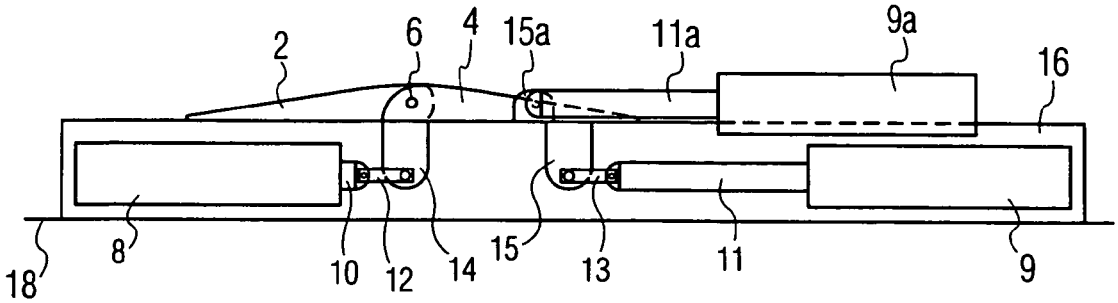

As shown in FIGS. 8*c* and 8*d*, impact barrier 2 and sled 4 may be arranged above ground level 18 using housing 16, with energy absorbers 8, 9 and 9*a* located within or above housing 16. As with previous aspects, the various energy absorbers may be partially above or below ground level 18.

Figure 9A:
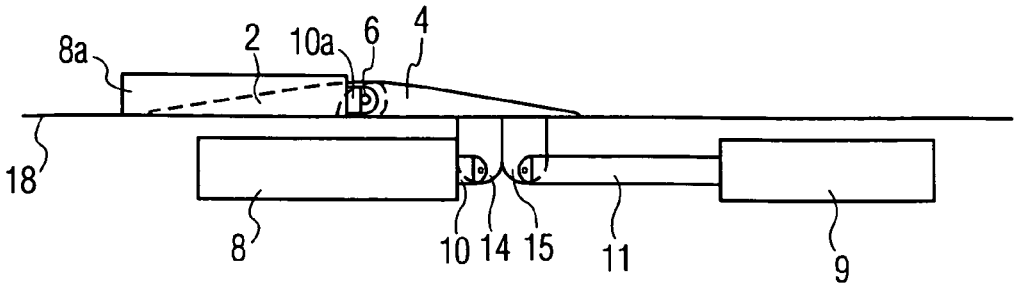
FIGS. 9*a*-9*d* show a side view of a retractable energy absorbing system according to additional aspects of the present disclosure.
Figure 9B:
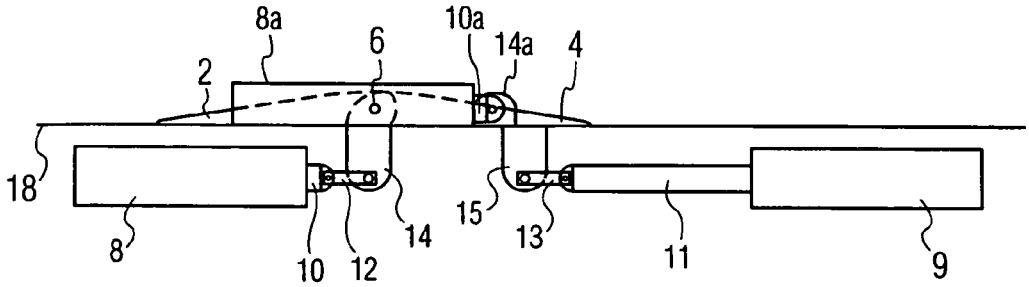

FIGS. 9*a*-9*d* show a side view of a retractable energy absorbing system according to aspects of the present disclosure. FIGS. 9*a*-9*d* show energy absorbers 8, 8*a* and 9 arranged in a manner such that an application of force to impact barrier 2 may cause pistons 10 and 10*a* to extend and piston 11 to compress. FIGS. 9*a* and 9*b* show impact barrier 2 and sled 4 above ground level 18, energy absorbers 8 and 9 located below ground level 18, and energy absorber 8*a* located at the side of sled 4 at or above ground level 18. As shown in FIG. 9*a*, pistons 10 and 11 may attach to flanges 14 and 15 at or near a distal end of sled 4, and pistons 10*a* may attach to hinge 6. As shown in FIG. 9*b*, piston 10 may attach to flange 14 at or near a proximal end of sled 4, pistons 10*a* and 11 may attach to flanges 14*a* and 15, respectively, at or near a distal end of sled 4.

Figure 9C:
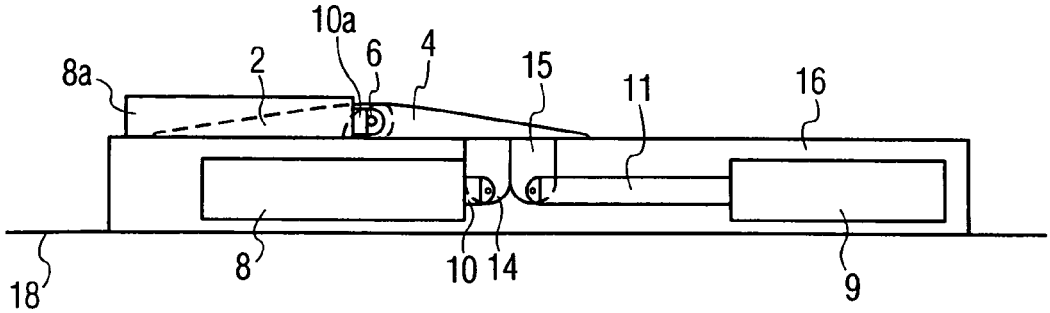
Figure 9D:
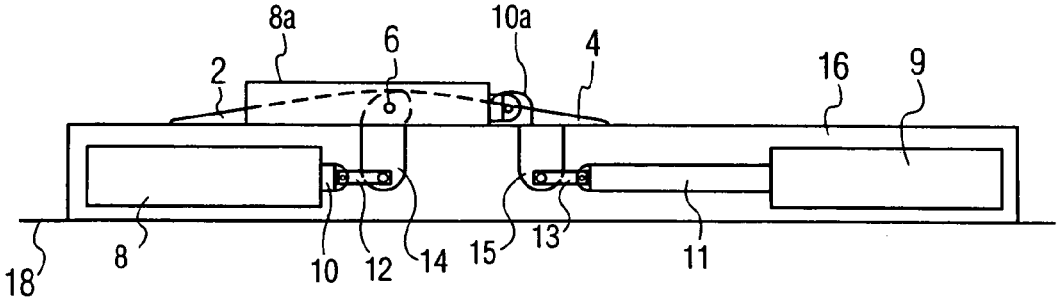

As shown in FIGS. 9*c* and 9*d*, impact barrier 2 and sled 4 may be arranged above ground level 18 using housing 16, with energy absorbers 8, 8*a* and 9 located within or above housing 16. As with previous aspects, the various energy absorbers may be partially above or below ground level 18.

Figure 10:
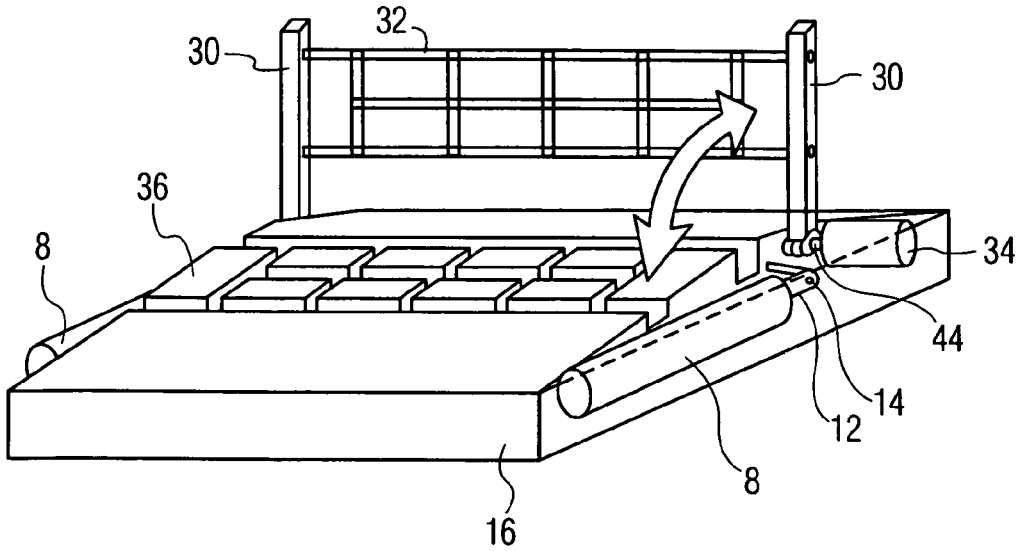
FIG. 10 shows a perspective view of a retractable energy absorbing system according to another aspect of the present disclosure.

FIG. 10 shows a perspective view of a retractable energy absorbing system according to another aspect of the present disclosure. In this aspect, impact barrier 2 includes deployment arms 30, shown in an upright position, and net 32. When impact barrier 2 is in a lowered position, as shown in FIG. 1, net 32 may rest within net pit 36, which is formed to accommodate net 32. Net pit 36 may be connected to and travel with impact barrier 2 and sled 4 upon application of force to impact barrier 2.

In this and other aspects, impact barrier 2 may be raised and/or lowered using a raising/lowering device 34 and shaft 44. Raising/lowering device 34 may be, for example, an electric rotary motor, which may be connected to and travel with impact barrier 2 and sled 4. In one aspect, raising/lowering device 34 may be controlled by a computer system (not shown) operated automatically and/or by a user. In other aspects, the impact barrier 2 may be raised/lowered manually using, for example, a lever, spring, hydraulic jack, air cylinder, rotation mechanism or counterweight.

Figure 11:
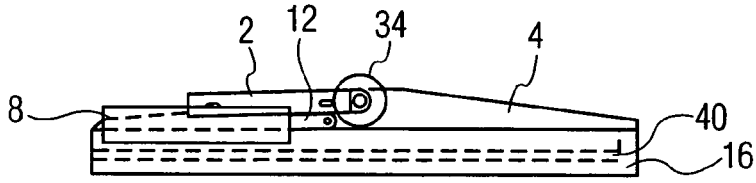
FIG. 11 shows a side view of a retractable energy absorbing system according to another aspect of the present disclosure.
Figure 12:
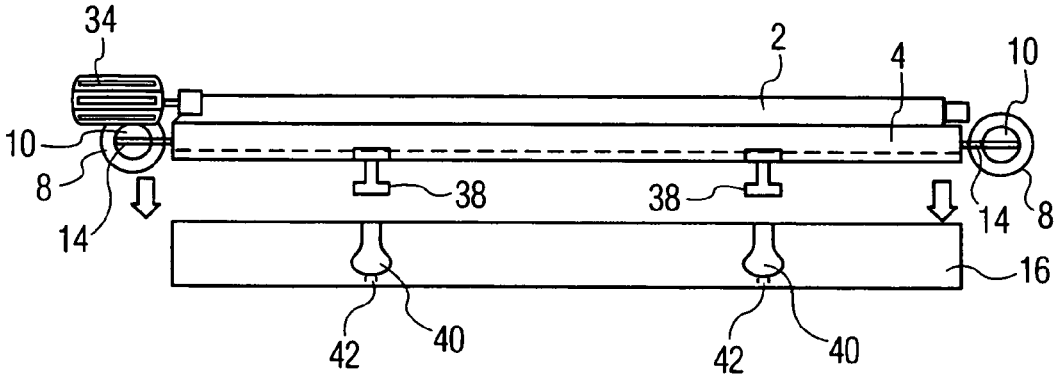
FIG. 12 shows a front view of a retractable energy absorbing system according to another aspect of the present disclosure.

As shown in FIGS. 10, 11 and 12, impact barrier 2, sled 4 and net pit 36 may be arranged atop housing 16, with energy absorber 8 located within or above housing 16. Alternatively, energy absorbers 8 may be arranged in a number of configurations, including those described above.

FIG. 12 shows a front view of a retractable energy absorbing system according to another aspect of the present disclosure. As shown, sled 4 and/or net pit 36 may have rails 38 that fit in channels 40 and provide guidance in a direction when force is applied to sled 4. Channels 40 may have drainage holes 42. When housing 16 is present, channels 40 may be located within housing 16. In other aspects, channels 40 may be fixed to or in the ground.

As shown in FIGS. 14*a*, 14*b*, 15, 16*a* and 16*b*, brackets 50 and 52 may be attached to impact barrier 2 and/or sled 4 and may limit the rotation of impact barrier 2 and provide support. The angle of rotation of impact barrier 2 may be determined by the size and arrangement of brackets 50 and 52. In one aspect, brackets 50 and 52 may be constructed of steel or other rigid material.

Figure 16A:
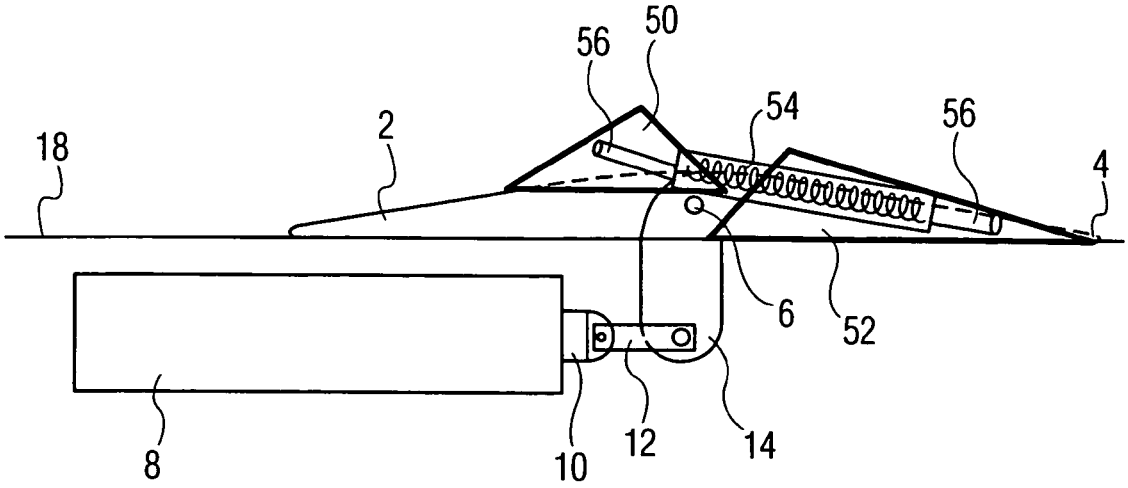
FIGS. 16*a* and 16*b* show a side view of a retractable energy absorbing system according to another aspect of the present disclosure.
Figure 16B:
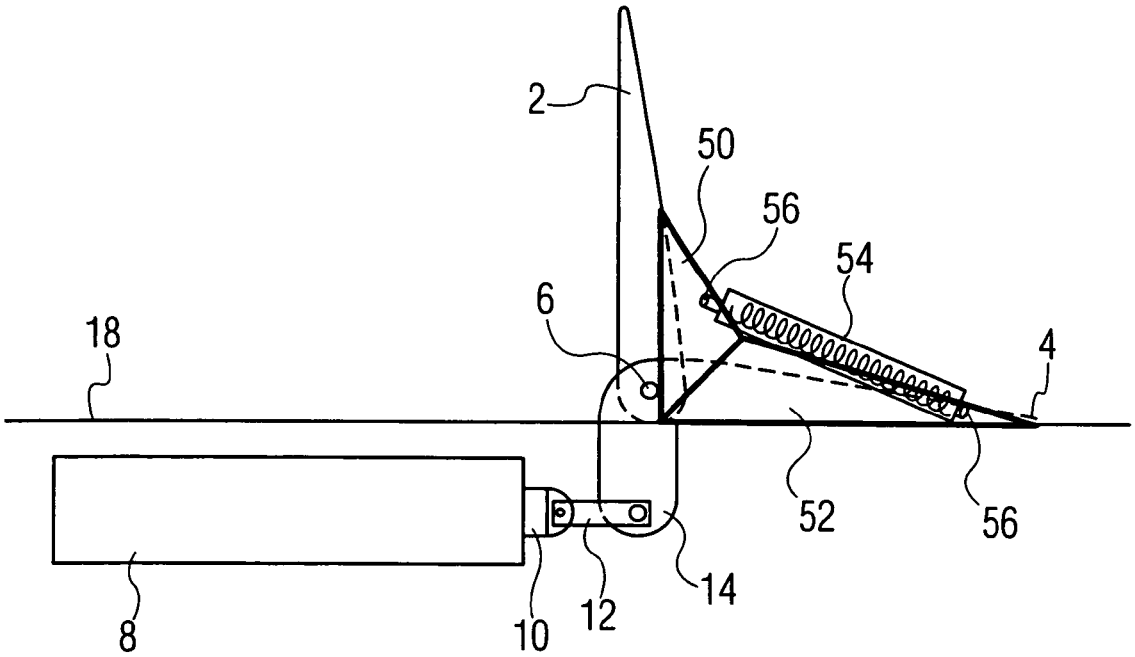

In an effort to reduce the loads experienced by brackets 50 and 52 as well as the overall system during impact, a variety of cushioning techniques may be applied to brackets 50 and 52. One such example is a foam cushion, which may be several inches thick depending on the nature of the application and may provide cushioning between the contact surfaces of brackets 50 and 52 during impact. As shown in FIGS. 16*a* and 16*b*, another example of cushioning may be a bracket energy absorber 54, such as a spring or self-contained shock-absorber that may be attached to the side of or in between brackets 50 and 52 using shafts 56, and that may resist the rotation of impact barrier 2 during impact.

Figure 17:
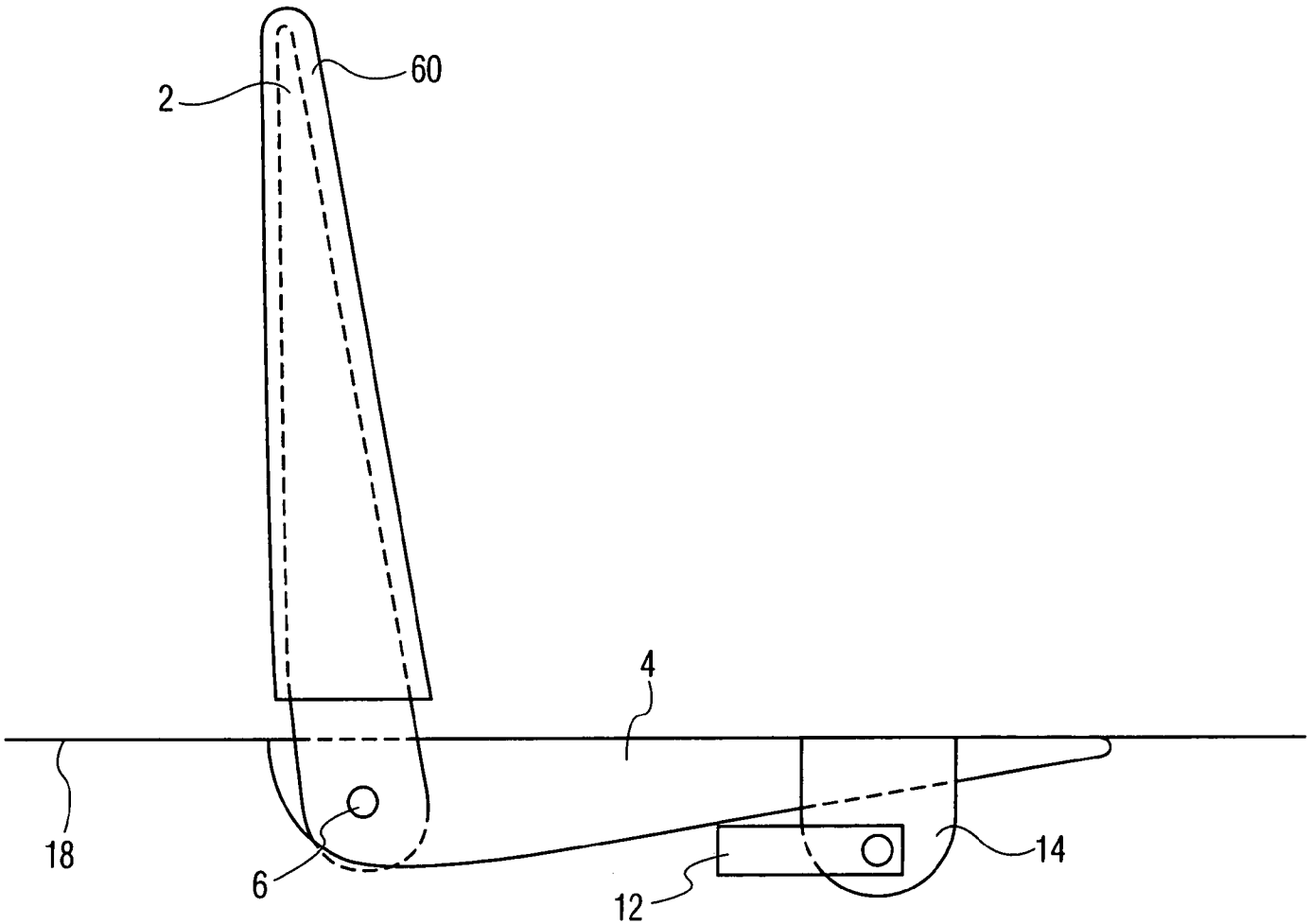
FIG. 17 shows a side view of a retractable energy absorbing system according to another aspect of the present disclosure.

As shown in FIG. 17, an impact barrier cover 60 may cover some or all of the impact barrier 2 and may protect a vehicle 20 and impact barrier 2 from damage, particularly during low speed impacts. The impact barrier cover 60 may be constructed using thick, compressible material (e.g. foam rubber) that deforms locally.

Figure 18A:
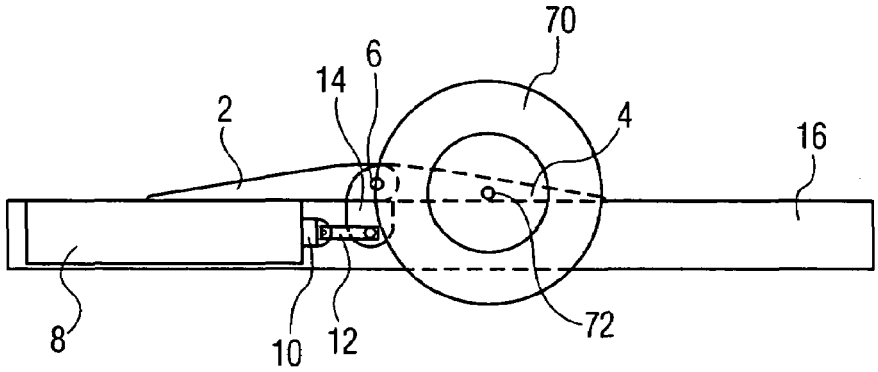
FIGS. 18*a* and 18*b* show a side view of a retractable energy absorbing system according to another aspect of the present disclosure.
Figure 18B:
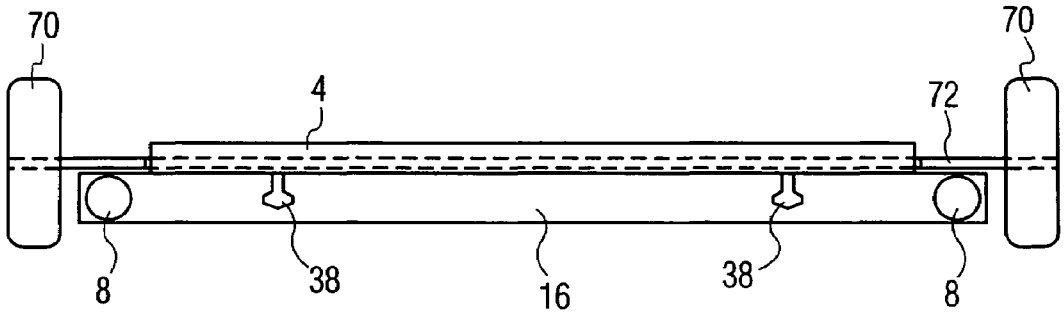

As shown in FIGS. 18*a* and 18*b*, the retractable energy absorbing system may include wheels 70, and/or casters, tracks/treads, rollers, etc. to facilitate transportation and orientation. Wheels 70 may be used in conjunction with trailer-hitches, goose-neck attachments, or fifth-wheel style attachments. Wheels 70 may be affixed to the unit using axle 72, or using independent axle, tandem axle, removable, or hinged wheels.

Figure 19A:
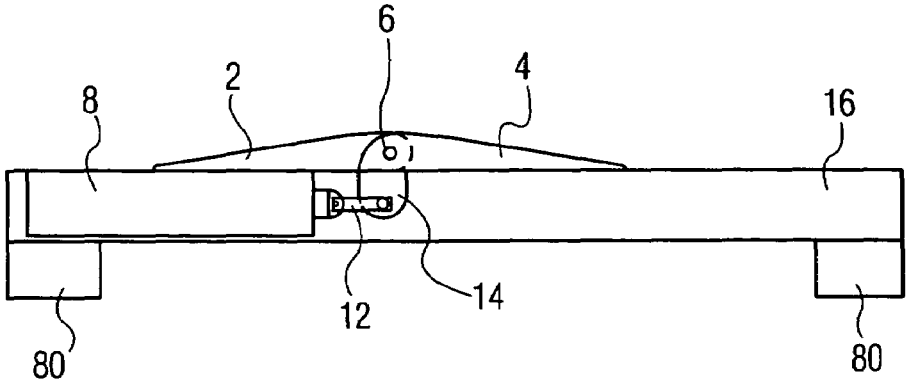
FIGS. 19*a* and 19*b* show a side view of a retractable energy absorbing system according to another aspect of the present disclosure.
Figure 19B:
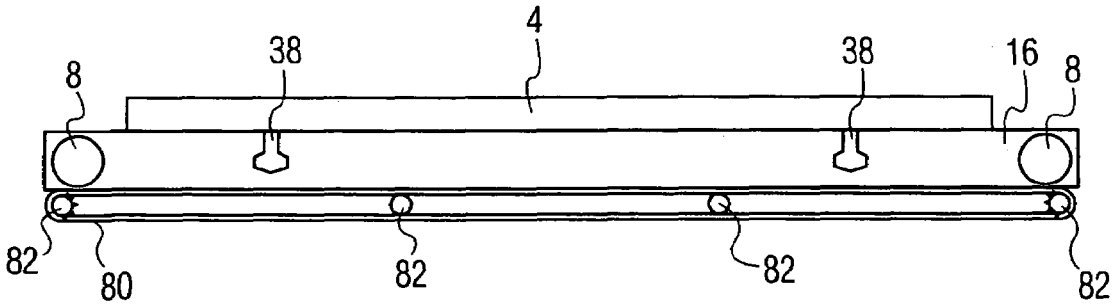

As shown in FIGS. 19*a* and 19*b*, the retractable energy absorbing system may include treads 80 driven by sprockets 82. Sprockets 82 may be connected to a power and control system (not shown) that may be operated by a user to position the retractable energy absorbing system.

Figure 20A:
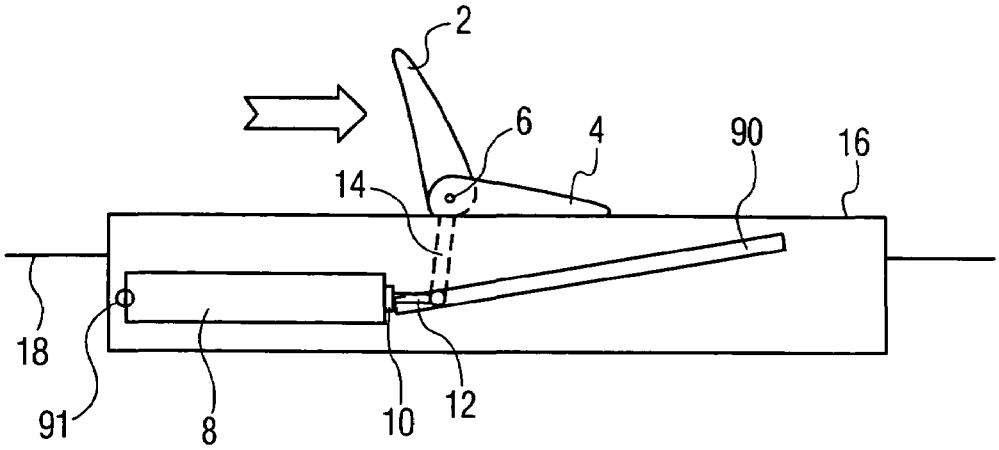
FIGS. 20*a* and 20*b* show a side view of a retractable energy absorbing system according to another aspect of the present disclosure.
Figure 20B:
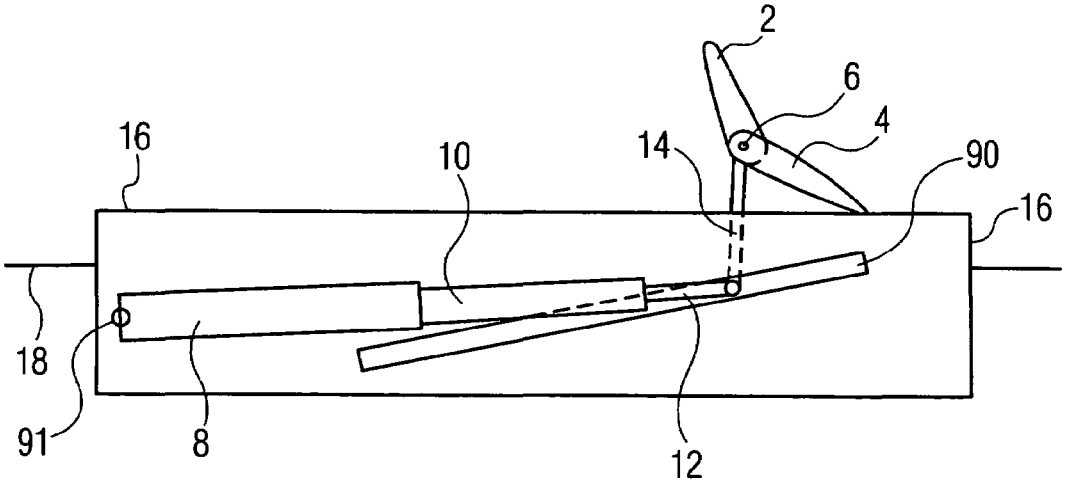
Figure 21A:
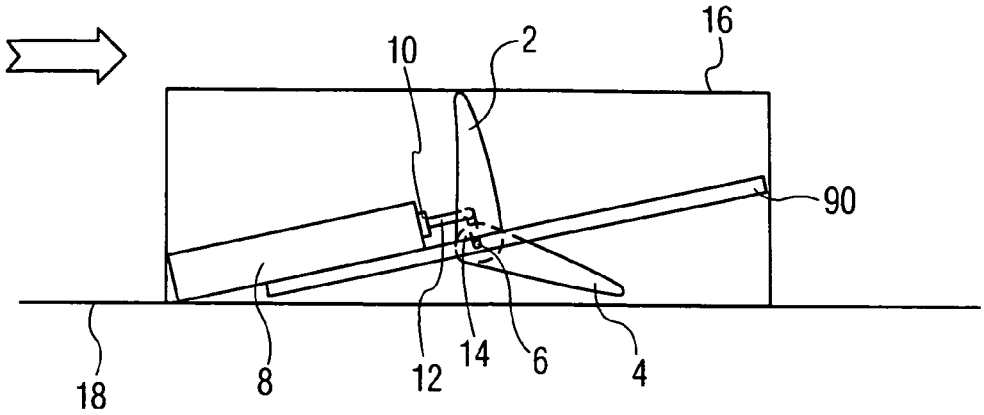
FIGS. 21*a*-21*c* show views of a retractable energy absorbing system according to another aspect of the present disclosure.
Figure 21B:
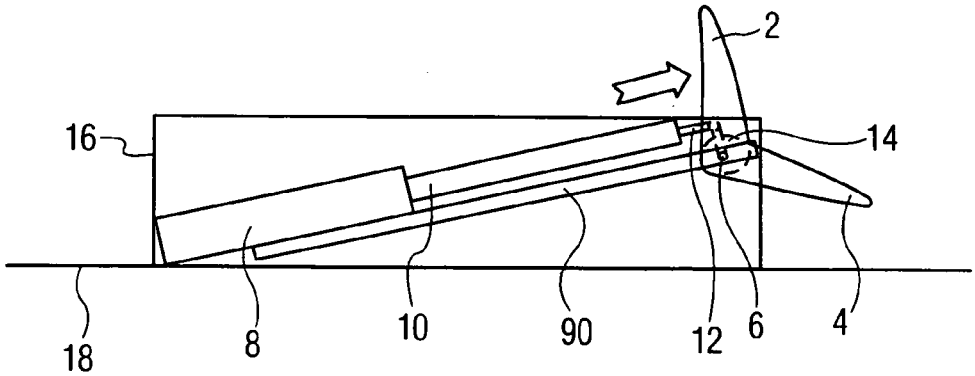
Figure 21C:
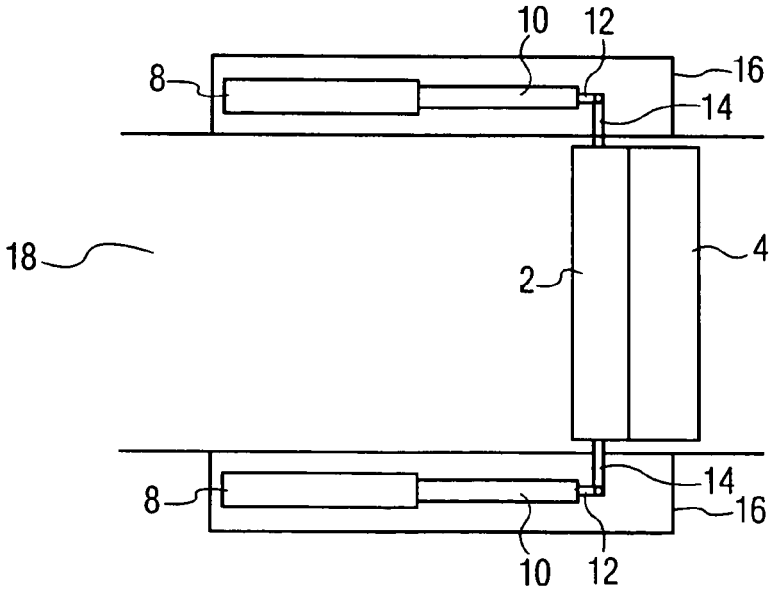
Figure 22A:
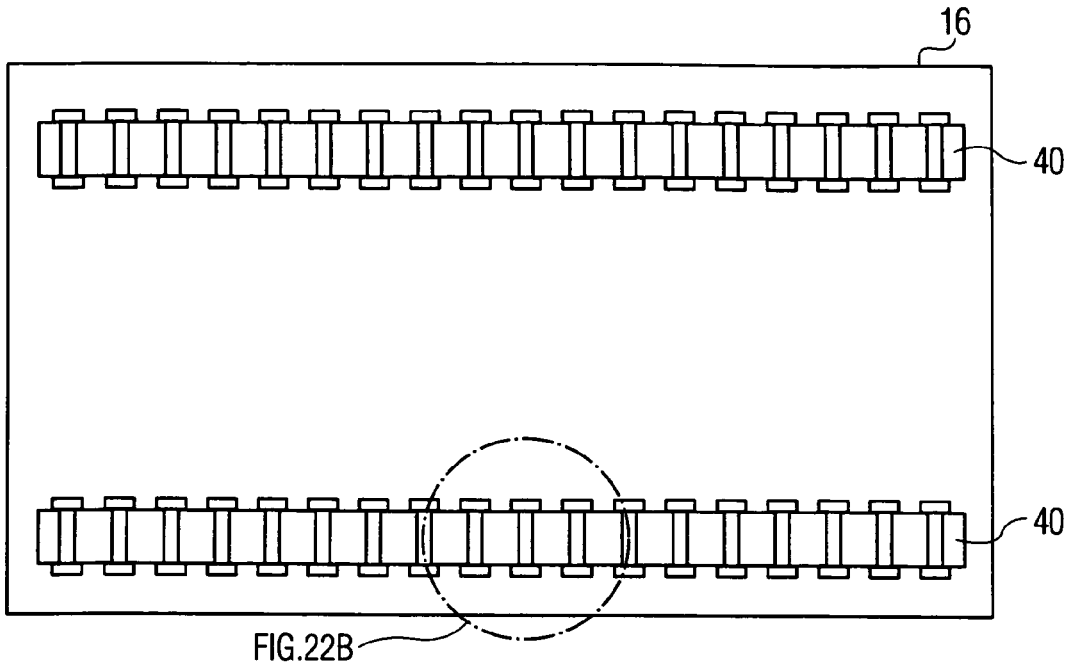
FIGS. 22*a*-22*c* show a top view of channels and shear pins according to another aspect of the present disclosure.
Figure 22B:
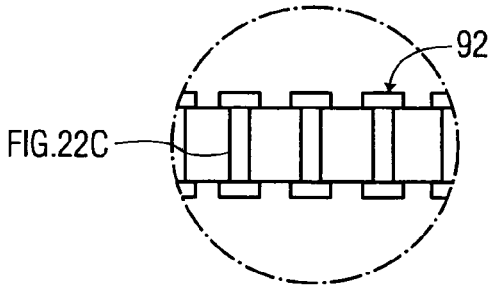
Figure 22C:
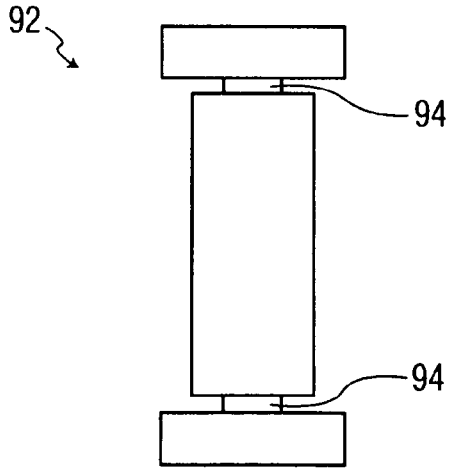
Figure 23A:
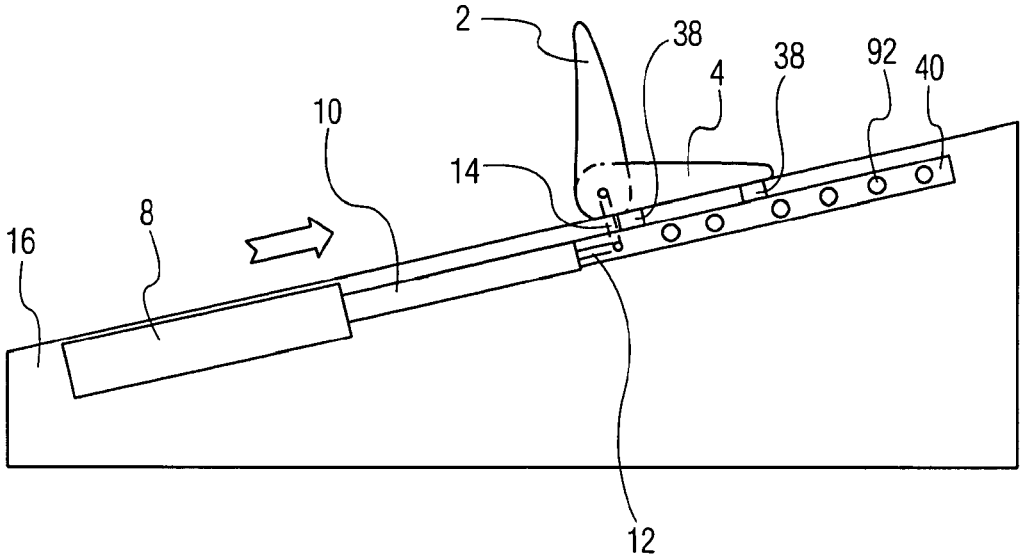
FIGS. 23*a* and 24*a* show side views of a retractable energy absorbing system according to another aspect of the present disclosure.
Figure 23B:
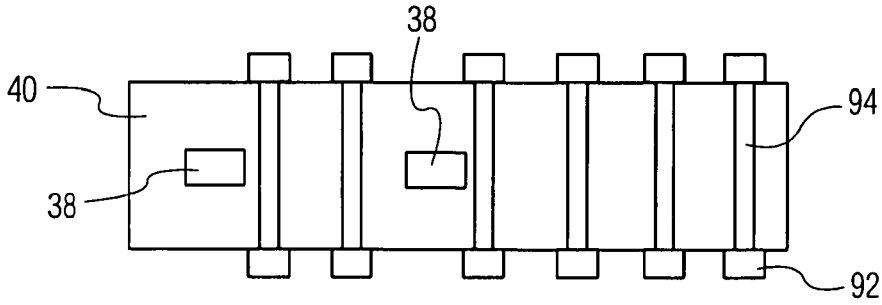
FIGS. 23*b* and 24*b* show top views of channels and shear pins according to another aspect of the present disclosure.
Figure 24A:
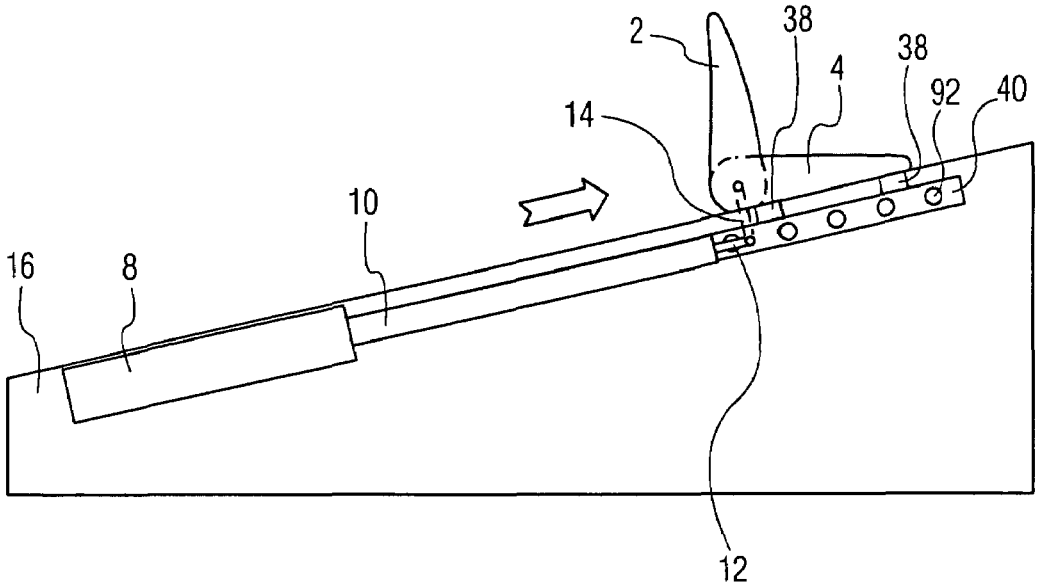
Figure 24B:
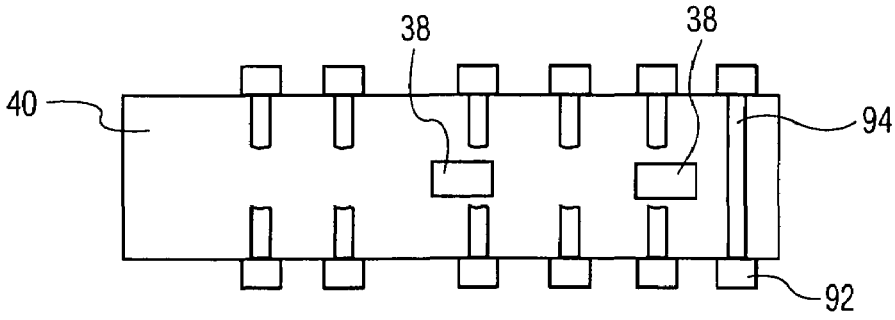

As shown in FIGS. 20*a* and 20*b*, additional energy dissipation may occur when guide 90 is present which controls the movement of sled 4 and may cause connector 12, flange 14, impact barrier 2 and sled 4 to travel along the slope of guide 90 as piston 10 expands and energy absorber 8 pivots on hinge 91. FIGS. 20*a* and 20*b* show such a system with housing 16 located partially below ground level 18, before and after impact, respectively. In another aspect, FIGS. 21*a*, 21*b* and 21*c* show a system with housing 16 located above ground level 18, with FIG. 21*c* showing a top view.

Similarly, with respect to FIGS. 10-12, rails 38 and channels 40 may be used in energy dissipation, for example, by having rails 38 and/or guides 40 arranged on an increasing slope, thereby causing the impact barrier 2, sled 4 and net pit 36 to follow along that slope as they travel after impact.

As shown in FIGS. 22*a*, 22*b*, 22*c*, 23*a*, 23*b*, 24*a*, and 24*b*, channels 40 may be fitted with an arrangement of one or more supplemental energy absorbers, such as breakable shear pins 92. Rails 38 may slide along channels 40 and break shear pins 92 causing sled 4 to decelerate as it travels. Shear pins 92 may break at shear zones 94, upon application of force based on specified shear strengths. Shear pins 92 may be arranged uniformly or at increments based on the type of installation. Similarly, guide 90 may be fitted with such supplemental energy absorbers.

Although illustrative embodiments have been described herein in detail, it should be noted and will be appreciated by those skilled in the art that numerous variations may be made within the scope of this invention without departing from the principle of this invention and without sacrificing its chief advantages.

Unless otherwise specifically stated, the terms and expressions have been used herein as terms of description and not terms of limitation. There is no intention to use the terms or expressions to exclude any equivalents of features shown and described or portions thereof and this invention should be defined in accordance with the claims that follow.

What is claimed is:

1. An energy absorbing system, comprising:

a supporting member having a rail in mechanical communication with a channel;

one or more frangible members arranged such that the rail causes the one or more frangible members to break when the supporting member moves from a first position to a second position;

an energy absorber mechanically coupled to the supporting member; and a barrier mechanically coupled to the supporting member, the barrier pivotable between a first angular position and a second angular position, where a vehicle passes over the barrier when the barrier is in the first angular position and where the vehicle engages and imparts a force on the barrier when the barrier is in the second angular position, thereby causing the supporting member to move from the first position to the second position, wherein the channel is arranged on an incline such that the second position is at a height greater than the first position.

2. The energy absorbing system of claim 1, wherein the energy absorber is arranged such that the energy absorber expands when the supporting member travels from the first position to the second position.

3. The energy absorbing system of claim 1, wherein the energy absorber is arranged such that the energy absorber compresses when the supporting member travels from the first position to the second position.

4. The energy absorbing system of claim 1, wherein the channel is located in a housing.

5. The energy absorbing system of claim 1, wherein at least a portion of each of the one or more frangible members are located within the channel.

6. The energy absorbing system of claim 1, wherein the frangible members have shear zones that break upon application of a predetermined force.

7. The energy absorbing system of claim 1, wherein the frangible members are arranged along the channel at uniformly spaced locations.

8. An energy absorbing system, comprising:

barrier means for pivoting between a first angular position where a vehicle passes over the barrier and a second angular position where the vehicle engages and imparts a force on the barrier;

supporting means for supporting the barrier means as the barrier means and the support means travel from a first position to a second position when the vehicle engages the barrier;

guide means for guiding the barrier means and the supporting means along an incline as the barrier means and supporting means travel from a first position to a second position; and energy absorbing means for absorbing energy as the barrier means and supporting means travel from a first position to a second position.

9. The energy absorbing system of claim 8, wherein, when in the first angular position, the barrier means is not high enough to encounter a vehicle, and, when in the second angular position, the barrier means is high enough to encounter the vehicle thereby causing the barrier means and the supporting means to move from the first position to the second position.

10. The energy absorbing system of claim 8, further comprising:

housing means containing at least a portion of the guide means and at least a portion of the energy absorbing means.

* * * * *